US005795238A

United States Patent [19]

Nicholson

[11] Patent Number: 5,795,238

[45] Date of Patent: Aug. 18, 1998

[54] GOLF STROKE TRAINING APPARATUS

[76] Inventor: Robert Steven Nicholson, 12205 Torrey Pines Point, Knoxville, Tenn. 37922

[21] Appl. No.: 915,338

[22] Filed: Aug. 21, 1997

[51] Int. Cl.[6] ..... A63B 69/36

[52] U.S. Cl. ..... 473/214; 473/276; 473/213

[58] Field of Search ..... 473/212, 213, 473/214, 215, 276, 277, 274, 208

[56] References Cited

U.S. PATENT DOCUMENTS

| | | | |
|---|---|---|---|
| 3,415,524 | 12/1968 | Vickers | 473/214 |
| 3,740,052 | 6/1973 | Arkin | 473/214 |
| 4,239,228 | 12/1980 | Norman et al. | 473/212 |
| 4,241,922 | 12/1980 | Elliott, Jr. | 273/189 A |
| 4,451,044 | 5/1984 | Elliott, Jr. | 273/189 A |
| 5,188,365 | 2/1993 | Picard | 273/189 R |
| 5,259,621 | 11/1993 | Keefer | 273/187.2 |
| 5,499,820 | 3/1996 | Albertsson | 273/189 A |
| 5,501,464 | 3/1996 | Dalbo | 273/187.2 |
| 5,593,353 | 1/1997 | Kramer | 473/205 |
| 5,658,203 | 8/1997 | Shub | 473/205 |
| 5,685,787 | 11/1997 | Kogut | 473/212 X |

*Primary Examiner*—George J. Marlo

*Attorney, Agent, or Firm*—Luedeka, Neely & Graham, P.C.

[57] ABSTRACT

The apparatus described in the specification comprises a golf stoke training apparatus for developing muscle memory relative to a golf stroke. The apparatus includes a flexible strap having a shoulder portion, a first arm portion and attachment device for attaching the first arm portion to a golfer's arm and a second arm portion and finger strap for attaching the second arm portion to a golfer's hand in order to maintain the golfer's wrist in a flexed position during the golf stroke. The device is relatively simple, inexpensive to manufacture and substantially maintains the golfer's arms and shoulders in a fixed position relative to one another throughout the golf swing so that muscle memory is developed in the golfer relative to the stroke.

32 Claims, 4 Drawing Sheets

GOLF STROKE TRAINING APPARATUS

The invention relates to an apparatus to be worn by a golfer for the purpose of helping the golfer to develop a proper putting stroke.

BACKGROUND

During a game of golf, there are several golf swing strokes which must be mastered in order to improve the golfer's game and lower the golfer's score. Such strokes include, but are not limited to, driving, pitching, chipping and putting strokes. Of the strokes, the putting stroke is extremely important and if executed properly and consistently can make a significant impact on a golfer's score. During the putting stroke, the arms, and shoulders of the golfer should move in unison as the putter is swung from a back stroke toward and through the ball position. Despite the importance of a proper putting stroke, currently available golf training devices often fail to provide suitable means for assuring that the arms and shoulders move in unison during the putting stroke. Furthermore, many of the training devices are relatively expensive and may not be readily adaptable to either right or left hand golfers.

Accordingly, it is an object of the invention to provide a golf stroke training apparatus for use in developing a proper golf swing.

Another object of the invention is to provide a golf stroke training apparatus which instills muscle memory in a golfer's arms and shoulders in order to provide substantially consistent putting stokes.

Yet another object of the invention is to provide an inexpensive, relatively simple apparatus for golf stroke training.

Still another object of the invention is to provide a golf stroke training device which can be used by golfers of any stature to improve their putting stroke.

Another object of the invention is to provide a golf stroke training device which can be worn either by a right hand or a left hand golfer.

SUMMARY OF THE INVENTION

With regard to the above and other objects, the invention provides a golf stroke training apparatus including a flexible harness having a shoulder portion positioned between a first arm portion and second arm portion, the first arm portion having a length and at least one forearm securement device along the length of the first portion for attaching the first portion to a forearm of a golf trainee and the second arm portion having an adjustable finger loop for attaching the second portion to a finger of the golf trainee's hand thereby securing the second portion to the trainee so that the trainee's arms and shoulders move in unison during a golf stroke.

In another aspect, the invention provides a putting stroke training apparatus consisting essentially of a flexible harness and structure for attaching the harness to a golf trainee. The apparatus comprises a shoulder strap, a first arm portion pending from one end of the shoulder strap, the first arm portion having an attachment device for attaching the first arm portion to an arm of the trainee and a second arm portion pending from an opposing end of the shoulder strap and containing a finger loop for attaching the second arm portion to a finger of the trainee in order to flex the trainee's wrist, whereby the trainee's arms and shoulders are caused to move in unison by the apparatus during a putting stroke to instill muscle memory in the trainee in response to a repetition of the putting stroke made by a trainee wearing the apparatus.

Yet another aspect of the invention provides a golf stroke training system for attachment to a golf trainee. The system comprises limiting means for limiting movement of one arm of the trainee relative to the trainee's other arm and to the trainee's shoulders and means for attaching the limiting means to selected portions of one arm and a hand on the other arm of the trainee, wherein the limiting means limits movement of the arms and shoulders of the trainee such that the movement of a golf club having a head by the trainee in a putting motion between two spaced apart points on each side of a golf ball causes the trainee's arms and shoulders to move in a plane parallel to the direction of movement of the golf club head in a pendulum-like motion.

An advantage of the training apparatus according to the invention is that it may be made of a variety of lightweight, flexible materials and the construction and assembly of the apparatus lends itself to economical mass production. Despite its relative simplicity, the apparatus provides a substantially unified movement of the shoulders and arms of the golf trainee during a putting stroke which induces muscle memory in the trainee throughout the putting stroke. When the apparatus is properly mounted on a golf trainee, it provides interconnection between the trainee's arms and shoulders so that as a golf club is moved to a back swing position and from the back swing toward the ball and through the ball in a plane of motion, the upper torso of the golfer is substantially prevented from moving significantly outside the plane of motion of the club. Accordingly, the golf club head is urged in a straight line toward the ball so that the ball is projected substantially perpendicular to the club head. When the apparatus is removed after a sufficient training period, the trainee's muscles are sufficiently instilled with the unified motion to cause the same motion to be repeated.

Another advantage of the apparatus according to the invention is that the apparatus is adjustable to fit golf trainees of different stature and can be used by either right-handed or left-handed trainees.

BRIEF DESCRIPTION OF THE DRAWINGS

Other benefits and advantages of the invention will be evident from the drawings in conjunction he following description in which.

DETAILED DESCRIPTION OF THE PREFERRED EMBODIMENTS

Figure 1:
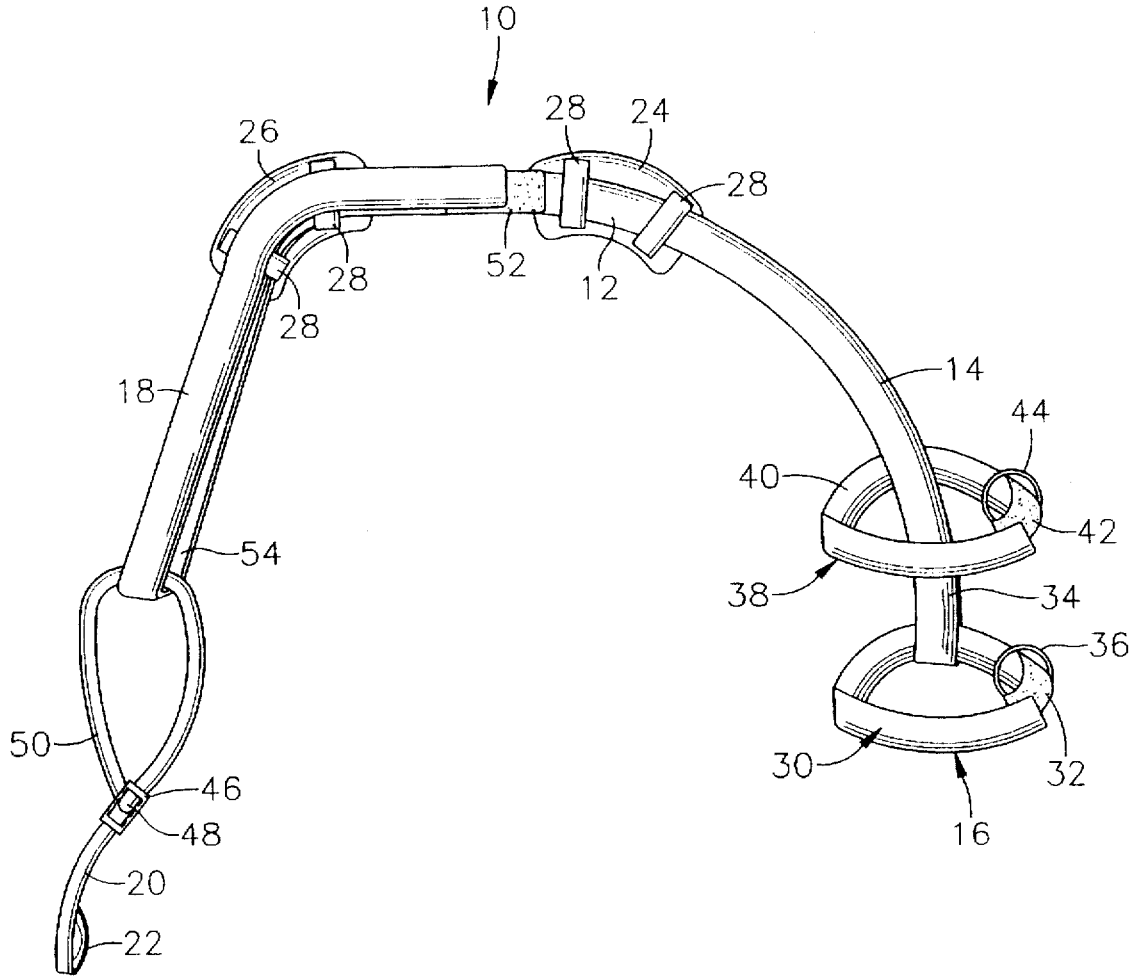
FIG. 1 is a perspective view of a golf stoke training apparatus according to the invention.

With reference to FIG. 1, there is provided a golf stroke training apparatus 10 including a shoulder harness portion 12 attached at one end to a first arm portion 14 having at least one arm band 16 for attaching the first arm portion 14 to a forearm of a golf trainee and a second arm portion 18 attached to an opposing end of the shoulder harness 12 and having an adjustable strap 20 and finger loop 22 for attaching the second arm portion 18 to a little finger of the trainee's hand. For the purposes of the invention, the terminology "shoulder harness portion" means the portion of the apparatus which will lie substantially adjacent a golf trainee's shoulders when the apparatus is attached to the trainee. Accordingly, the actual length of the shoulder portion 12 may vary with the stature of the golfer.

The training apparatus 10 may be made out of a variety of flexible, substantially inelastic, durable materials such as leather, canvas, nylon, cotton or fiberglass cloth which is lightweight and relatively strong. It is preferred that the apparatus contain sufficient adjustable attachment devices so that the apparatus can be fitted to golf trainees of different stature. Accordingly, the apparatus should be adjusted and attached to a golf trainee so that during a putting stroke the relative positions of the shoulder harness 12, finger loop 22 and arm band 16 do not significantly shift on the trainee's arms and shoulders as the trainee swings a putter.

The apparatus 10 preferably also includes shoulder pads 24 and 26 which are attached to and are preferably positionable along the shoulder harness 12. The shoulder pads 24 and 26 provide added comfort to the golf trainee and increase the ability of the apparatus to maintain the shoulder motion in unison with the arm motion. The shoulder pads 24 and 26 may be attached to the shoulder harness 12 in a variety of ways including buttons, snaps, hook and loop material and other fasteners. Preferably the shoulder pads 24 and 26 contain fabric loops 28 sewed or glued to the pads through which the shoulder harness 12 of the apparatus passes.

The first arm portion 14 of the apparatus has a length of flexible material which extends along the outer periphery of one arm of the trainee and is attached to the trainee's forearm using arm band 16. The arm band 16 preferably includes a strap 30 and adjustment means 32 which is attached to a portion 34 of the first portion 14 which would lie adjacent a trainee's forearm. The adjustment means 32 is preferably provided by mating strips of hook and loop material, with the loops on one surface of the strap 30 releasably mateable with hooks on an opposing surface of the strap 30 so that the strap is adjustable over a diameter sufficient to fit arms of different circumferences. A preferred hook and loop material is available under the tradename VELCRO from Velcro U.S.A., Inc. of New York, N.Y. The adjustment means 32 may also contain a metal ring or fabric loop 36 for use in tightening the strap 30 around the trainee's forearm.

The hook and loop material fastener of the adjustment means 32 should be sufficiently strong to reduce the tendency for the strap 30 to unfasten or move during use.

It is preferred that the strap 30 remain in substantially the same position on the trainee's forearm in order to maintain the trainee's arm in an essentially fixed position relative to his or her shoulders.

It is preferred that the first arm portion 14 contain a second arm band 38 spaced apart from the first arm band 16 along the length of the first portion 14. The second arm band 38 provides added support to maintain the trainee's arm in unison with his or her shoulders during the putting motion. That is, there is no appreciable movement of the arm relative to the shoulder so that the path of the putter held by the trainee replicates a pendulum-type motion and the club head moves in a substantially straight line when viewed from above the trainee's head.

The second arm band 38 comprises a strap 40 and a fastening means 42 and is attached to the first portion 14 for attaching the first portion 14 to the upper arm of a golf trainee. The second attachment device 38 also contains an adjustment means 42 and a ring or loop 44 for use in adjusting and tightening the strap 38 on the trainee's upper arm. Although not required, more than two attachment devices may be used to attach the first portion to the trainee's arm.

The first portion 14 may be removably attached to either the right or left arm of the golf trainee depending on whether the trainee is right-handed or left-handed. If the trainee is right-handed, the first portion is attached to his or her left arm and vice versa if the trainee is left-handed, the first portion is attached to his or her right arm.

The second arm portion 18 of the apparatus is preferably provided by a length of flexible material positionable along the outside periphery of the trainee's other arm. The second arm portion 18 may contain an adjustable strap 20 having a finger loop 22 for looping around a little finger of the trainee's hand to maintain the trainee's wrist in a flexed position when the trainee is holding a golf club with both hands. The strap 20 preferably includes an adjustment device 46 such as a buckle having one end 48 of the strap 20 attached thereto. A second portion 46 of the strap may pass through the adjustment device 46 so that the position of the finger loop 22 is adjustable relative to the second arm portion 18 of the apparatus.

It is preferred that the second arm portion 18 of the apparatus also be adjustable so that the distance of the finger loop 22 from the shoulder portion 12 may be readily adjusted to fit golf trainees of different stature. Accordingly, an adjustment system 52 is provided at least along a portion of the second arm portion 18. A preferred adjustment system is a mating hook and loop material fastener having loop material attached to one surface of the second arm portion 18 and hook material attached to an opposing surface of the second arm portion 18 thereby providing a loop 54 for holding the strap 20. It will be recognized, however, that the strap 20 may be attached to the second arm portion 18 in a variety of ways and need not be removably attached to the second arm portion 18 provided the strap 20 has an adjustable length sufficient for attaching to arms of different lengths.

Any or all of the above described adjustment and attachment means may be comprised of straps and buckles, buttons, snaps and/or hook and loop material fasteners of the type commonly used with athletic equipment. Regardless of the adjustment and attachment devices selected, it is desirable that the apparatus be relatively fixed in a selected position on a trainee's arms and shoulders in a manner sufficient to induce the trainee's arms and shoulders to move in unison during a putting stroke to produce a pendulum-like movement of a golf club. Accordingly, the adjustment and attachment devices should be sufficiently strong to substantially prevent the apparatus from moving laterally along the trainee's shoulders and arms when practicing the putting stroke. Additional front and/or back straps positionable along the chest and/or back of a trainee and connecting the first arm portion 14 to the second arm portion 18 may be used to further secure the apparatus on a trainee in a fixed position.

Figure 2:
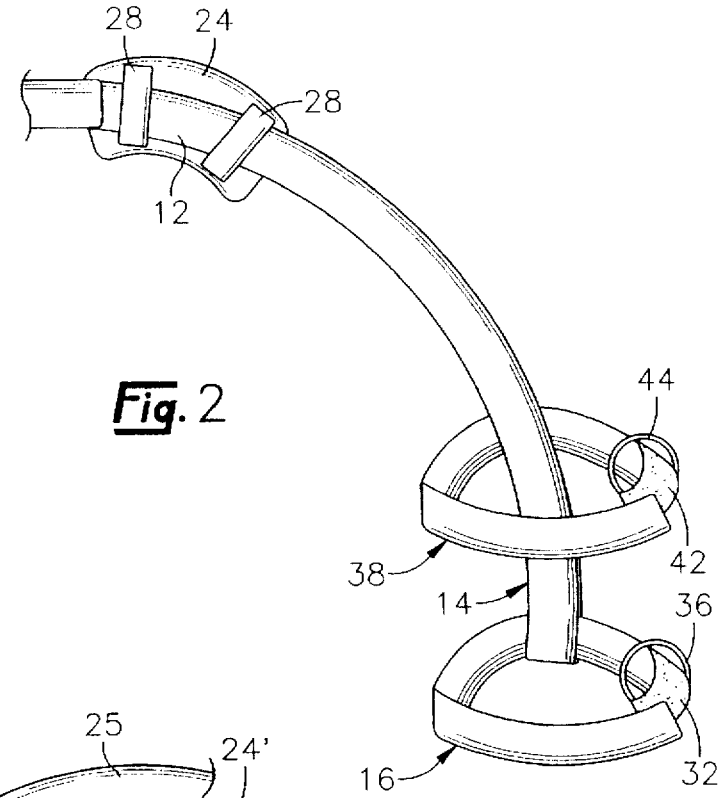
FIG. 2 is a partial perspective view of one portion of a golf stroke training apparatus according to invention.
Figure 3:
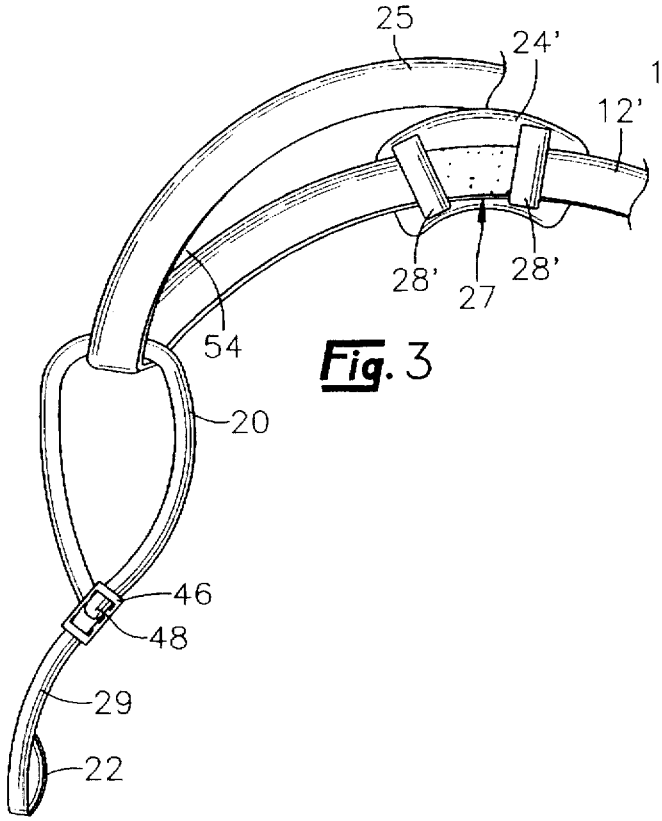
FIG. 3 is a partial perspective view of another portion of a golf stroke training apparatus according to the invention.

Detailed aspects of the first and second arm portions of the apparatus according to the invention are shown in FIGS. 2 and 3. The first arm portion 14 of the apparatus contains a length of flexible material extending from a shoulder harness 12 on one end thereof to adjustable arm bands 16 and 38 which are attached to the first portion 14 a sufficient distance from the shoulder harness 12 so that when the first portion 14 is attached to a trainee's arm, arm band 16 is positioned on a trainee's forearm about midway between the trainee's wrist and elbow and arm band 38 is positioned on the trainee's upper arm about midway between the trainee's elbow and shoulder.

Arm bands 16 and 38 may be fixedly or removably attached to the first portion 14 by sewing, gluing or using snaps or hook and loop material fasteners to attach a portion of the arm bands to the flexible material of the first portion 14. Use of hook and loop material fasteners is preferred so that the positions of the arm bands 16 and 38 may be adjusted to properly fit the trainee.

The shoulder harness 12 also preferably contains a shoulder pad 24 which is attached to the shoulder harness 12 so that the pad 24 lies adjacent a trainee's shoulders when the apparatus is being worn by a trainee. The shoulder pad 24 may be made of any padding material such as foam rubber, cotton, as well as other known padding materials. In the case of foam rubber, the pad 24 is preferably covered with a natural or synthetic cloth.

The shoulder pad 24 may be fixedly or movably attached to the shoulder harness 12 by any of the well known attachment means. It is preferred that loops 28 be sewn to the shoulder pad covering material in a spaced apart relationship. The loops 28 preferably have a size sufficient to allow the shoulder harness to pass therethrough and to provide movability of the shoulder pad 24 along the lateral length of the shoulder harness portion 12 sufficient to comfortably fit the trainee. The loops 28 may be made of the same or of a different material than the shoulder pad covering material.

The second arm portion 18 of the apparatus is shown in FIG. 3. The second arm portion 18 comprises a length of flexible material which preferably extends from the shoulder harness portion 12' having a shoulder pad 24' attached thereto to adjustable strap 20 containing a finger loop 22. Loop 54 in the second arm portion 18 may be made by selecting a length of flexible material sufficient to extend through a loops 28' on shoulder pad 24', through the strap 20 and back to the shoulder harness portion 12' adjacent shoulder pad 24'. In the alternative, hook and loop material fasteners may be used to selectively position the shoulder pads 24 and 24' along the shoulder harness portion 12.

A hook and loop material fastener may be used to attach portion 25 to shoulder harness portion 12'. The hook and loop material fastener contains loop material 27 attached to the shoulder harness portion 12' and hook material attached to a mating portion 25 of the flexible material which lies adjacent the loop material 27 when attached thereto to form loop 54.

Strap 20 is shown attached to the second portion 18 as by threading the strap 20 through loop 54 or by threading the flexible material comprising the second arm portion 18 through a loop in strap 20. An adjustable buckle 46 having one end 48 of the strap 20 attached thereto is slidably attached to the strap 20 to provide a loop portion 29 containing finger loop 22. Buckle 46 provides adjustment of the distance the finger loop 22 extends from loop 54. Finger loop 22 may also be adjustable, as by sliding, to adjust the size of finger loop 22 to fit a trainee's little finger.

Figure 4:
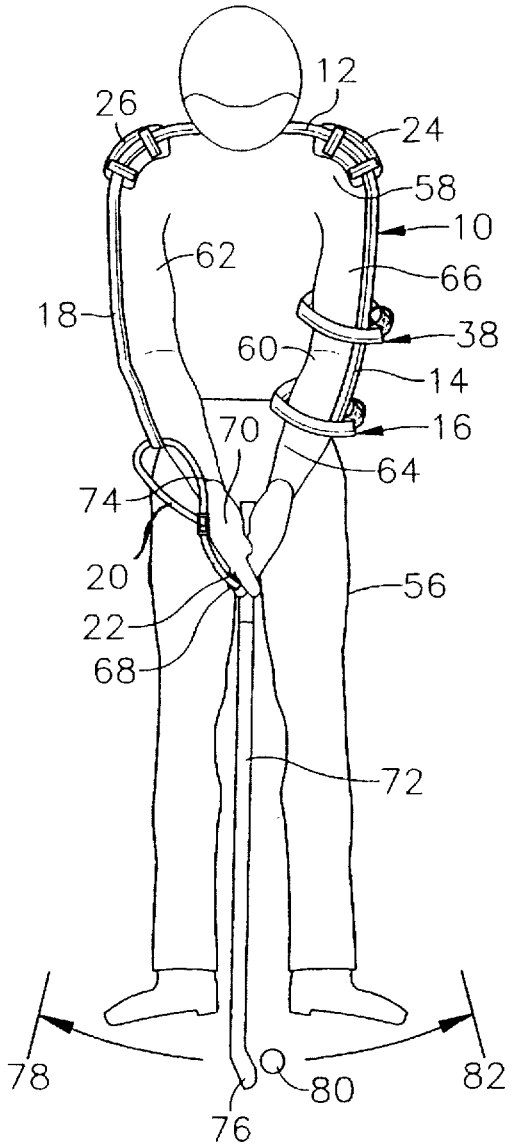
FIG. 4 is a front view of a golfer wearing a golf stroke training apparatus according to the invention.

Referring now to FIG. 4, there is shown a golf trainee 56 wearing the apparatus 10 according to the invention. As shown in FIG. 2, the shoulder harness portion 12 of the apparatus containing shoulder pads 24 and 26 is positioned so that it lies across the trainee's shoulders 58. The shoulder portion 12 is attached on one end to the first portion 14 which extends along the outer area of the trainee's left arm 60 and is attached on the opposite end to the second portion 18 which extends along the outer area of the trainee's right arm 62. The first portion 14 is attached to the trainee's forearm 64 using arm band 16 and to the trainees upper arm 66 using arm band 38 so that the first portion 14 is substantially fixed in position along the outer periphery area of arm 60.

The second portion 18 is attached to the trainee's little finger 68 of his or her right hand 70 with finger loop 22 attached to strap 20. The second portion 18 is adjusted to fit sufficiently taut along the trainee's right arm 62 so that when the club handle 72 is grabbed, the trainee's right hand 70 is urged in a position that flexes wrist 74 toward the club handle 72.

The second portion 18 may also be removably attached to the trainee's right arm 62 with attachment means similar to arm bands 16 and 38. However, strap 20 and finger loop 22 provide sufficient connection to the trainee's right arm 62 to cause the right arm 62 to move in unison with shoulders 58 when the second portion 18 is properly positioned on the outer periphery of the trainee's right arm 62. If desired, additional attachment means may be removably attached to the trainee's right arm 62 at one or more locations along the length of arm portion 18.

With reference to FIG. 4, it will be seen that as the trainee 56 moves the club head 76 toward the back swing position 78 and then through the ball 80 to the follow through position 82, the apparatus 10 causes the trainee's upper torso, arms 60 and 62 and shoulders 58 to move in a plane parallel to the direction of movement of the club head 76.

Figure 5:
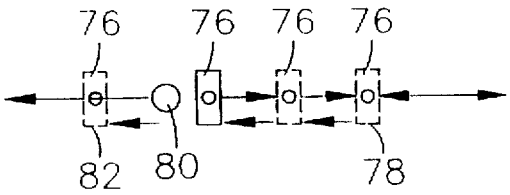
FIG. 5 is a top view of the direction of travel of a putter head during a putting stroke showing the direction of travel of the head by a golfer wearing a golf stroke training apparatus according to the invention.

The direction of travel of the club head 76 during a putting stroke is shown in detail in FIG. 5. The apparatus 10 of the invention induces a trainee using the apparatus to move the club head 76 from position 78 on the back swing in a straight line pendulum-like motion through the ball 80 to a follow through position 82. Because the club head is caused to move in substantially a straight line motion when the trainee is properly wearing the training apparatus of the invention, the ball will move in substantially the same direction as the direction of travel of the club head. As will be appreciated, movement of the club head 76 in a straight line will impart a desired direction of travel to the golf ball 80 when struck by the head 76 of the club.

Figure 6:
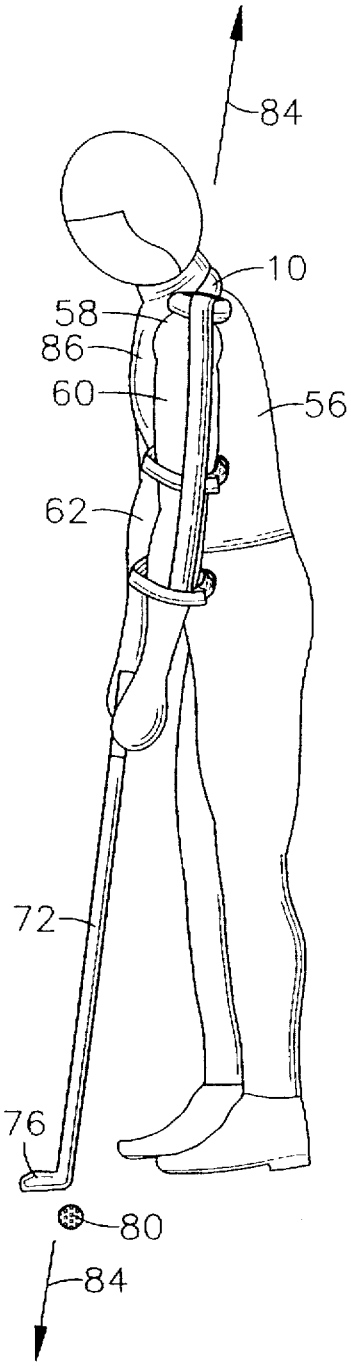
FIG. 6 is a side view of a golfer wearing a golf stroke training apparatus according to the invention.

Viewed from the left side of trainee 56 as shown in FIG. 6, the arms 60 and 62 and shoulders 58 of the trainee 56 move in plane indicated by arrows 84 so that his or her shoulders and arms move in unison as the club head 76 strikes the ball 80. Repeated use of the apparatus according to the invention will induce muscle memory so that a substantially reproducible motion of the upper torso 86 of the trainee in plane 84 will result.

Having described and illustrated various aspects and embodiments of the invention, it will be appreciated that many modifications, rearrangements, additions, improvements and substitutions may be made to these embodiments by those of ordinary skill all of which are nevertheless within the spirit and scope of the invention as defined in the appended claims.

What is claimed is:

1. A golf stroke training apparatus comprising a flexible strap having a shoulder portion positioned between a first arm portion and a second arm portion, the first arm portion having a length and at least one forearm securement device along the length thereof for attaching the first portion to a forearm of a golfer and the second arm portion having an adjustable finger strap for attaching the second arm portion to a golfer's hand for maintaining the golfer's wrist in a flexed orientation relative to a golf club.

2. The golf stroke training apparatus of claim 1 wherein the flexible strap comprises an inelastic material.

3. The golf stroke training apparatus of claim 2 wherein the inelastic material comprises nylon cloth webbing.

4. The golf stroke training apparatus of claim 1 wherein the shoulder portion of the strap is adjustable.

5. The golf stoke training apparatus of claim 1 wherein the forearm securement device is adjustable around the forearm of the golfer.

6. The golf stroke training apparatus of claim 5 wherein the forearm securement device is adjustably positioned along the length of the first arm portion.

7. The golf stroke training apparatus of claim 1 wherein the first arm portion further includes an upper arm securement device.

8. The golf stroke training apparatus of claim 7 wherein the upper arm securement device is adjustable around the upper arm of the golfer.

9. The golf stroke training apparatus of claim 8 wherein the upper arm securement device is adjustably positioned along the length of the first arm portion.

10. The golf stroke training apparatus of claim 9 wherein the upper arm securement device comprises a hook and loop material fastener.

11. The golf stroke training apparatus of claim 1 wherein the forearm securement device contains a portion of hook material for mating with a portion of loop material on the first arm portion.

12. The golf stroke training apparatus of claim 1 further comprising left and right shoulder pads adjustably positionable on the shoulder portion.

13. The golf stroke training apparatus of claim 1 wherein the shoulder portion has a length which is adjustable by means of loop material opposing hook material adjacent the shoulder portion.

14. A putting stroke training apparatus consisting essentially of a flexible harness and structure for attaching the harness to a golf trainee, wherein the apparatus comprises a shoulder strap, a first arm portion pending from one end of the shoulder strap having a length sufficient to reach the trainee's forearm, the first arm portion having an attachment device for attaching the first arm portion to the forearm of the trainee and a second arm portion pending from an opposing end of the shoulder strap and containing a finger loop for attaching the second arm portion to a finger of the trainee in order to flex the trainee's wrist, whereby the trainee's arms and shoulders are caused to move in unison by the apparatus during a putting stroke to instill muscle memory in the trainee in response to a repetition of the putting stroke made by a trainee wearing the apparatus.

15. The training apparatus of claim 14 wherein the shoulder strap comprises an inelastic material.

16. The training apparatus of claim 15 wherein the inelastic material comprises nylon cloth webbing.

17. The training apparatus of claim 14 wherein the shoulder strap is adjustable.

18. The training apparatus of claim 14 wherein the attachment device is adjustable around a forearm of the trainee.

19. The training apparatus of claim 18 wherein the attachment device is adjustably positioned along the length of the first arm portion.

20. The training apparatus of claim 14 wherein the first arm portion contains a forearm attachment device and an upper arm attachment device.

21. The training apparatus of claim 20 where in the forearm and upper arm attachment devices are adjustable around the for arm and upper arm of the trainee.

22. The training apparatus of claim 20 wherein the forearm and upper arm attachment devices are adjustably positioned along the length of the first arm portion.

23. The training apparatus of claim 22 wherein the attachment devices contain hook material portion for mating with loop material portion on the first arm portion.

24. The training apparatus of claim 14 wherein the attachment device contains a hook material portion for mating with a loop material portion on the first arm portion.

25. The training apparatus of claim 14 further comprising left and right shoulder pads adjustably position on the shoulder strap adjacent a trainee's shoulders.

26. The training apparatus of claim 14 wherein the shoulder strap has a length which is adjustable by means of a loop material portion opposing a hook material portion on the strap adjacent the trainee's shoulders.

27. A golf stroke training system for attachment to a golf trainee, the system comprising limiting means for limiting movement of each arm of the trainee relative to the trainee's other arm and to the trainee's shoulders and means for attaching the limiting means to selected portions of the arms and hands of the trainee, wherein the limiting means limits movement of the arms and shoulders of the trainee such that the movement of a golf club having a head by the trainee's in a putting motion between two spaced apart points on each side of a golf ball causes the trainee's arms and shoulders to move in a plane parallel to the direction of movement of the golf club head in a pendulum-like motion.

28. The training system of claim 27 wherein the limiting means comprises an in elastic nylon web material.

29. The training system of claim 27 wherein the limiting means comprises an adjustable shoulder strap.

30. The training system of claim 27 wherein the limiting means comprises arm attachment devices for adjustably attaching the limiting means to one arm of the trainee and a hand attachment device for adjustably attaching the limiting means to a hand on the other arm of the trainee.

31. The training system of claim 30 wherein the arm attachment devices comprise a forearm attachment device and an upper arm attachment device.

32. The training system of claim 30 wherein the hand attachment device comprises an adjustable loop of web material.

* * * * *

UNITED STATES PATENT AND TRADEMARK OFFICE

CERTIFICATE OF CORRECTION

PATENT NO : 5,795,238

DATED : August 18, 1998

INVENTOR(S) : Robert Steven Nicholson

It is certified that error appears in the above-identified patent and that said Letters Patent is hereby corrected as shown below:

Column 2, line 43, change "he" to --with the--;

Column 2, line 48, after "to" insert --the--;

Column 8, line 12, change "where in" to --wherein--;

Column 8, line 14, change "for arm" to --forearm--;

Column 8, line 38, change "trainee's" to --trainee--;

Column 8, line 44, change "in elastic" to --inelastic--.

Signed and Sealed this

First Day of December, 1998

*Attest:*

Bruce Lehman

BRUCE LEHMAN

*Attesting Officer*

*Commissioner of Patents and Trademarks*